US005295285A

United States Patent [19]

Shely

[11] Patent Number: 5,295,285

[45] Date of Patent: Mar. 22, 1994

[54] CABLE TIE

[75] Inventor: William W. Shely, St. Charles, Ill.

[73] Assignee: All-States Inc., Chicago, Ill.

[21] Appl. No.: 5,609

[22] Filed: Jan. 19, 1993

[51] Int. Cl.[5] ..... B65D 63/00

[52] U.S. Cl. ..... 24/16 PB; 24/17 AP

[58] Field of Search ..... 24/16 PB, 17 AP, 30.5 P, 24/484; 248/74.3; 292/318, 320, 322

[56] References Cited

U.S. PATENT DOCUMENTS

| | | | |
|---|---|---|---|
| 3,102,311 | 9/1963 | Martin et al. | 24/16 PB |
| 3,605,199 | 9/1971 | Eberhardt | 24/16 PB |
| 4,263,697 | 4/1981 | Speedie | 24/16 PB |
| 4,573,242 | 3/1986 | Lankton et al. | 24/16 PB |
| 4,788,751 | 12/1988 | Shely et al. | 24/16 PB |
| 4,897,899 | 2/1990 | Shely et al. | 24/16 PB |

*Primary Examiner*—Victor N. Sakran

*Attorney, Agent, or Firm*—Leydig, Voit & Mayer

[57] ABSTRACT

An improved cable tie having elongated generally semi-cylindrical beads longitudinally interconnecting the rack teeth on the cable tie strap so as to increase the material thickness adjacent a portion of the root sections of the rack teeth and to form an elongation of the transverse stress line and diversion thereof in a non-linear direction to increase the fracture resistance of the strap adjacent the rack teeth root sections where the strap has its minimum material thickness.

20 Claims, 2 Drawing Sheets

CABLE TIE

FIELD OF INVENTION

The present invention relates generally to cable ties and more particularly to cable ties having improved resistance to stress fractures.

BACKGROUND OF INVENTION

Cable ties are elongated devices used for holding a plurality of items or bundles of strand materials, such as tubes, wires or cables together. Cable ties are generally molded of plastic material and have a head and an integrally connected strap terminating in a free end or tail. The head includes an opening for progressive insertion of the tail and strap and houses a pawl integrally hinged in the head opening for engaging and gripping the strap. The pawl is formed with a plurality of transversely extending teeth which ratchet over a rack of teeth on the strap as the strap is pulled through the head opening and tightened around the tied items.

Various prior examples of such cable ties may be found in the U.S. Pat. No. 3,605,199 to Eberhardt and U.S. Pat. Nos. 4,788,751 and 4,897,899 to Shely et al., all of which are assigned to the same assignee as the present invention.

Cable ties are useful for a wide variety of purposes from tying bundles of wires and cables together, as the name implies, to securing packages and aligning and/or suspending tubes, pipes, conduits or other elongated items in their housings or supporting frameworks. Frequently, cable ties are employed during initial installation of various components and then become rather inaccessible for later repair or replacement. Also, the environment in which cable ties are used is often detrimental to their life. Conditions such as heavy loading, vibration and fluctuations in temperatures and humidity frequently place severe stress on the cable ties and the materials from which they are made.

As may be seen in the above-noted U.S. Pat. No. 3,605,199, the strap of the cable tie disclosed there has its minimum material thickness (i.e. is the thinnest) at the root of each tooth of the rack of teeth formed on the cable tie strap. Moreover, the strap loading is applied to the abutting faces of the rack teeth immediately adjacent the root section of an adjoining tooth. This loading not only applies a tensile stress to the strap at its weakest point but the offset forces on the teeth also apply a bending moment right along the sharply defined transverse line which forms the juncture of one tooth root with the adjacent tooth face. The concurrence of all of these factors; thinnest material, tensile and bending forces and sharply defined material transitions having a substantially linear direction, not only tend to produce stress fractures, but also, to rapidly propagate them along these transverse lines of weakness.

OBJECTS AND SUMMARY OF THE INVENTION

Accordingly, it is the primary aim of the present invention to provide a cable tie which due to its configuration has an improved resistance to stress fractures with little or no increase in its material thickness. It is also an object of the invention to provide such a cable tie that has equal or better holding characteristics compared to prior cable ties. A further and more specific object is to provide a cable tie of the foregoing kind that is relatively easy and economical to mold at high production speeds.

According to the present invention, an improved cable tie is provided having elongated generally semi-cylindrical beads longitudinally interconnecting the rack teeth on the cable tie strap so as to increase the material thickness adjacent a portion of the root sections of the rack teeth and to form an elongation of the transverse stress line and diversion thereof in a non-linear direction to increase the fracture resistance of the strap adjacent the rack teeth root sections where the strap has it minimum material thickness. In a preferred embodiment of the invention, a plurality of beads are disposed in substantially equally spaced-apart relation and the beads have a height less than the height of the rack teeth crests. Pursuant to another feature of the invention, one embodiment of the improved cable tie is formed with concave depressions which are located adjacent the rack teeth root sections and extend laterally from each side of the bead toward the sides of the cable strap. Preferably, the depth of the concave depressions is substantially equal to or less than the height of the bead.

These and other features and advantages of the invention will be more readily apparent upon reading the following description of the preferred exemplified embodiments of the invention and upon reference to the accompanying drawings wherein:

While the invention will be described and disclosed in connection with certain preferred embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENTS

Figure 1:
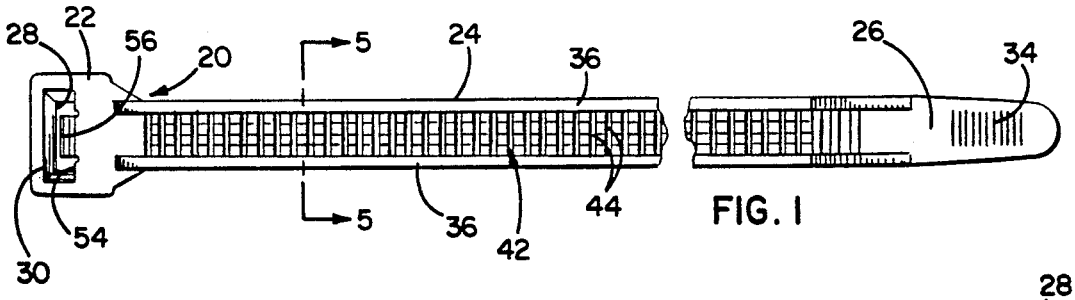
FIG. 1 is a top plan view of the front side of a cable tie made in accordance with the present invention.
Figure 2:
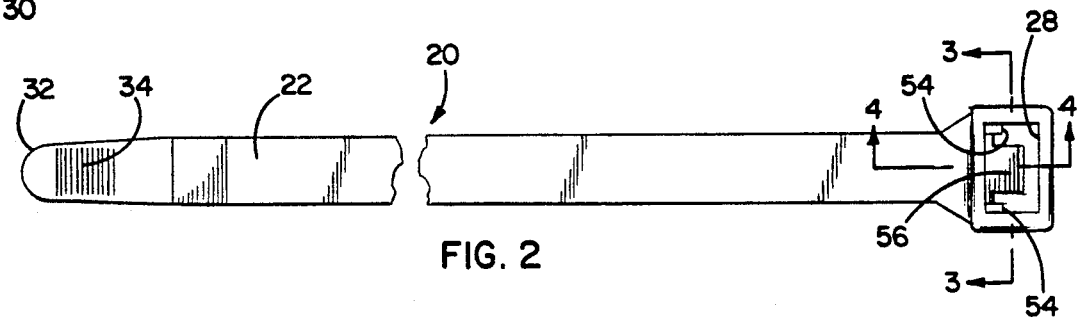
FIG. 2 is a plan view of the back side of the exemplary cable tie.
Figure 3:
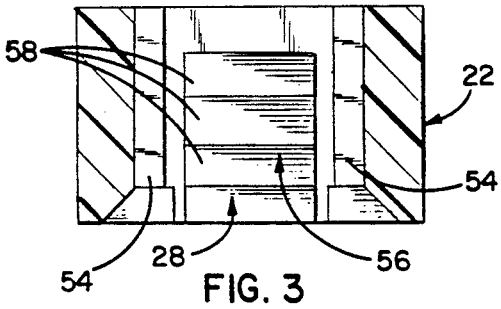
FIGS. 3 and 4 are transverse and longitudinal cross-sections, respectively of the cable tie of FIGS. 1 and 2, taken substantially along lines 3—3 and 4—4 in FIG. 2.

Turning now to the drawings, FIG. 1 illustrates a cable tie 20 embodying the features of the present invention. The cable tie 20 includes a head 22 and an elongated integrally connecting strap 24 which terminates in a free end or tail 26. The head 22 has an opening 28 through which the tail 26 and strap 24 may be progressively inserted. The front of the opening 28 is preferably chamfered or sloped at 30 to assist in guiding the tail 26 into the opening. In the preferred embodiment, the tail 26 has a rounded end 32 and the tail has a doubly tapered shape becoming both narrower and thinner toward the rounded end 32. The tapered configuration and the rounded end 32 of the tail 26 also facilitate the easy insertion of the tail into the head opening 28. As illustrated in FIGS. 1 and 2 both the front and back sides of the tapered tail 26 may be provided with a knurled or ridged surface 34 so that it may be more firmly and surely grasped between a person's thumb and finger as the strap 24 is pulled through the opening 28.

Figure 6:
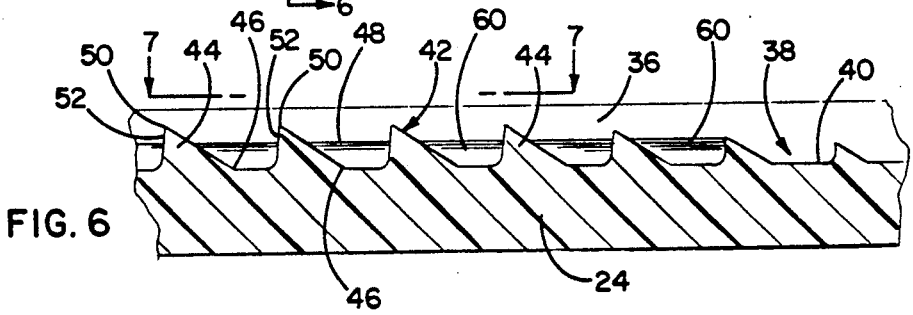
FIG. 6 is a fragmentary longitudinal cross-section taken substantially along line 6—6 in FIG. 5.

The strap 24 is formed with elongated side rails 36 along its edges which define a longitudinally extending channel 38 having a channel floor 40. The channel 38 contains a rack 42 formed of a plurality of successive, longitudinally spaced, transversely extending rack teeth 44. Referring more particularly to FIG. 6, each rack tooth 44 is formed with a portion merging integrally into the channel floor 40 to define a root section 46 and a ramp portion 48 inclined upwardly and outwardly from the root section to a sharp crest 50. Each tooth 44 also has an engagement face 52 which extends from the crest 50 to the channel floor 40 and is disposed substantially perpendicular thereto. When the strap 24 is inserted in the head opening 28, the side rails 36 along the edges of the strap engage a pair of shoulders 54 disposed within the head opening 28 to guide the movement of and position the strap within the opening.

Figure 4:
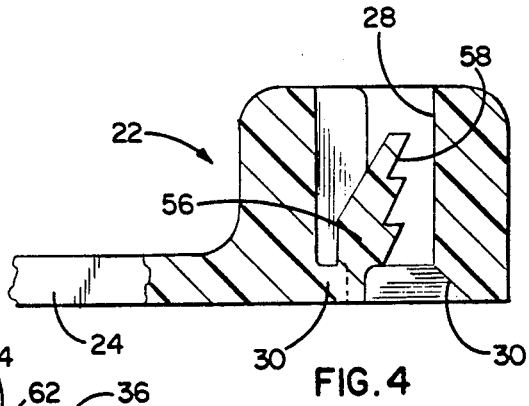

Turning back to FIGS. 1–4, it will be seen that the head 22 also houses a pawl 56 integrally hinged to the head in the head opening 28. The pawl 56 is formed with a plurality of transversely extending pawl teeth 58 each having a shape complimentary to the shape of the rack teeth 44. Thus, it will be understood and as shown in FIG. 4, each pawl tooth 58 includes a root section, an inclined ramp portion leading to a sharp transverse crest with an engagement face connecting one tooth crest with the root section of an adjacent tooth. As the strap 24 is pulled through the head opening 28, the pawl teeth 58 engage and ratchet over the rack teeth 44 and the engagement faces of the respective teeth are opposed so as to firmly abut one another and secure the strap 24 in the head 20. It will also be understood that the integral hinge of the pawl 56 and the resilience or spring imparted by the plastic material cooperate to bias the pawl 56 against the rack 42 on the strap 24 so as to insure positive engagement of their respective teeth. Moreover, as a holding load is applied to the strap 24, the pawl teeth 58 tend to bite even more firmly into the rack teeth 44.

Figure 5:
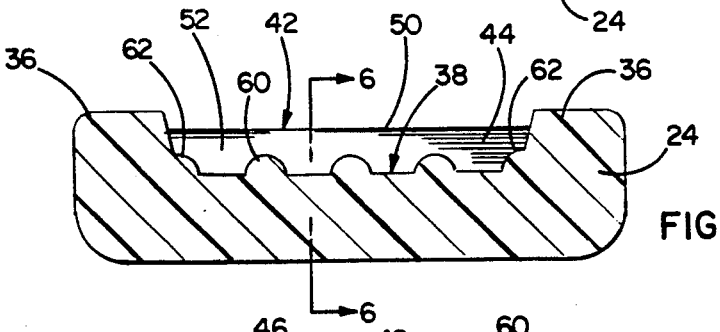
FIG. 5 is an enlarged transverse cross-section of the cable tie taken substantially along line 5—5 in FIG. 1.

In accordance with the present invention, the cable tie 20 is provided with at least one longitudinally extending bead 60 disposed in the channel 38 between and substantially parallel to the side rails 36 of the strap 24. In the embodiment illustrated in FIGS. 1, 5 and 6, three beads 60 are disposed in substantially equally spaced-apart relation to the side rails 36 and each bead 60 is substantially semi-cylindrical in shape having a generally rounded outer surface. Preferably, a pair of partial beads 62 are also disposed in the channel 38 and merge integrally into the side rails 36. As shown in FIG. 5, the partial beads appear substantially as quarter round filets interconnecting the side rails 36 and the channel floor 38.

Figure 7:
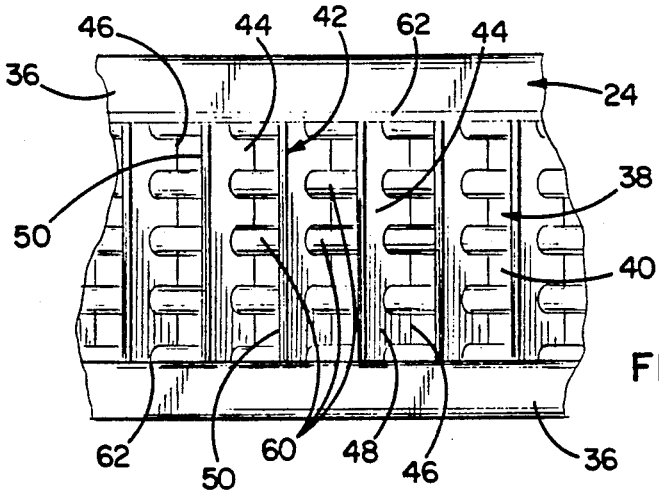
FIG. 7 is a fragmentary top plan view of the cable tie of FIGS. 1-6 as substantially as seen along line 7—7 in FIG. 6.

Pursuant to the invention and as shown in FIGS. 6 and 7, each of the beads 60, 62 integrally connects and longitudinally ties the rack teeth 44 successively together from the engagement face 52 of the one rack tooth to the ramp portion 48 of the next adjacent tooth. Also, in further accordance with the invention, the beads 60, 62 form an elongation of the transverse stress lines along the upper surface of the cable tie strap 24. Referring to FIG. 5, for example, it will be seen that the beads 60, 62 cause a diversion of the transverse stress line in a non-linear direction up and over the rounded outer surface of the beads. Accordingly, the beads 60, 62 not only increase the material thickness of the strap 24 in the channel floor along the transverse stress lines, but also, due to the elongation and non-linear diversion of the stress line, substantially increase the fracture resistance of the strap 24 adjacent the rack teeth root sections 46 where the strap has its minimum material thickness.

In keeping with a further aspect of the invention, each of the beads 60, 62 is formed with a height less than the height of the crests 50 of the rack teeth 44. In the embodiment illustrated in FIGS. 5 and 6, the beads 60, 62 have a height that is approximately one-half the height of the tooth crests 50. Thus, the engagement face 52 of each rack tooth 44 adjacent the crest 50 has an uninterrupted transverse edge for positive engagement with the face a corresponding tooth 58 on the pawl 56. Moreover, the crest of each pawl tooth 58, defining a relatively sharp transverse edge, is deformable so as to conform generally to the contour of the rounded outer surface of the beads 60, 62 when the pawl teeth 58 are pulled into firm gripping engagement with the rack teeth 44. As a consequence, the inclusion of the beads 60, 62 causes little if any diminution in the gripping engagement of the teeth 44 and 58 while affording a substantial increased resistance to stress fractures of the strap 24 along the transverse lines of weakness adjacent the rack teeth root sections 46 where the strap is the thinnest.

Figure 8:
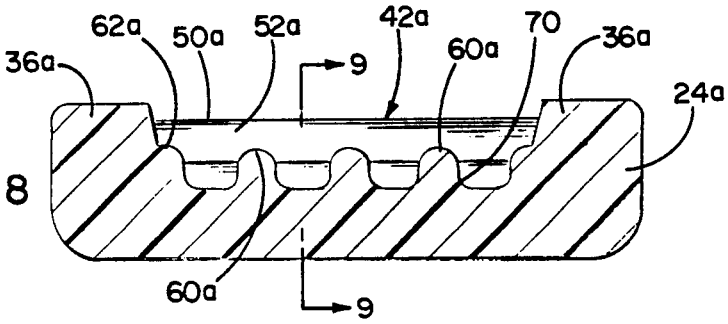
FIGS. 8, 9 and 10 are views similar to FIGS. 5, 6 and 7, respectively, of a modified alternative embodiment of the cable tie of the present invention.
Figure 9:
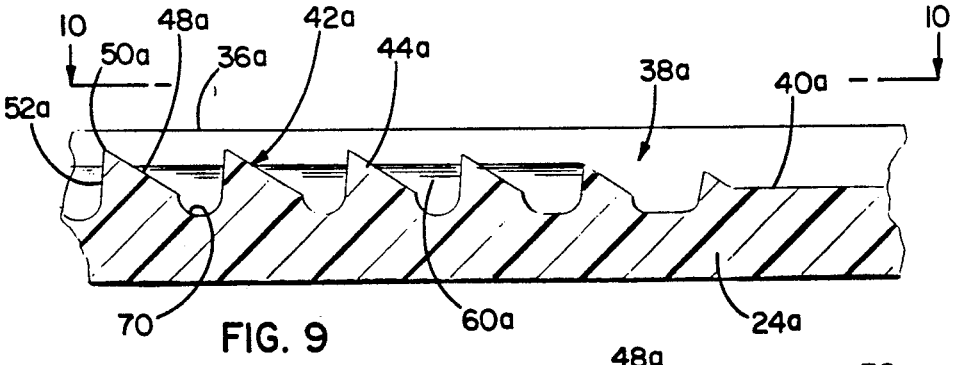
Figure 10:
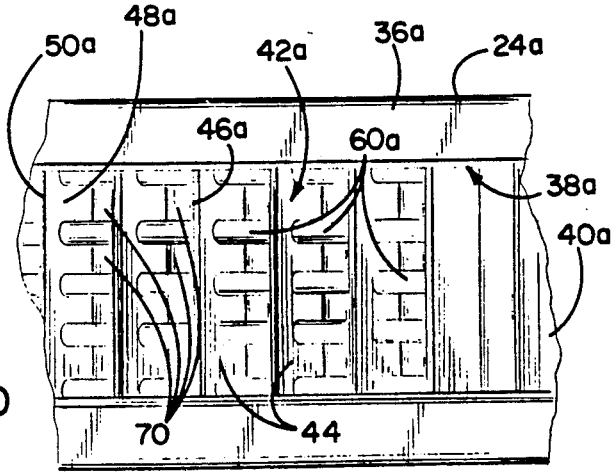

An alternative embodiment of a cable tie **20*a* is illustrated in FIGS. 8, 9, and 10 where similar reference numerals with the suffix a are used to designate parts similar to those previously illustrated and described in conjunction with FIGS. 1–7. As shown in FIGS. 8, 9, and 10, the channel floor 40*a* of the cable tie 20*a*, between the rack teeth root sections 46 and the adjacent engagement faces 52*a* of the rack teeth 44, is formed with generally rounded concave depressions 70 which extend laterally from each side of the beads 60*a* toward the side rails 36*a* of the strap channel 38*a*. Referring to FIG. 8, it will be seen that the concave depressions 70 together with the beads 60*a*, 62*a* define a transverse stress line that has a substantially sinusoidal shape where it bisects the depressions 70. This creates an even further elongation of the transverse stress line along the upper surface of the strap 24*a* and a smoothly undulating diversion of the stress line away from the linear direction. Additionally, as seen in FIG. 9, the concave depressions 70 form a much more gradually curved radius in the transition zone between the engagement face 52*a* of one rack tooth 44*a* and the root section 46** of an adjacent tooth.

In the preferred embodiment of the cable tie 20 illustrated in FIGS. 7–10, the height of the beads **60*a*, 62*a* is substantially less than the height of the rack teeth crests 50*a* and the depth of the concave depressions 70 is substantially equal to the height of the beads 60*a*, 62*a*. Thus, the beads 60*a*, 62*a* serve to increase the material cross-sectional area of the strap 24*a* in the channel floor 38*a* along each of the transverse stress lines by an amount that is substantially equal to or greater than the decrease in material cross-sectional area of the strap 24*a* created by the concave depressions lying along the transverse stress line. It will be appreciated, therefore, that cable ties 24*a* having a configuration including alternating rounded beads 60***a*, 62*a* and concave depressions 70 which interrupt and divert the transverse stress line have a much greater fracture resistance to tearing than conventional cable ties of the same nominal strap thickness where in the transverse stress lines are linearly directed.

From the foregoing, it will be appreciated that the improved cable ties of the present invention are much less subject to fatigue failure due to fluctuating loads, temperature and/or humidity conditions than conventional cable ties having substantially the same nominal strap thickness but substantially linearly directed transverse stress lines along their areas of minimum strap thickness. It will also be understood that the cable ties of the present invention are made of plastic material such as Nylon 66, polypropylene, or the like and that the strength comparisons with conventional cable ties are with those made of the same plastic material.

I claim as my invention:

1. A cable tie comprising in combination, a head and an elongated integrally connected strap terminating in a tail, said head having an opening for progressive insertion of said tail and strap, said strap being formed with elongated side rails defining a longitudinally extending channel having a channel floor, said channel containing a rack formed of a plurality of successive, longitudinally spaced, transversely extending rack teeth each having a portion merging integrally into said channel floor to define a root section, a ramp portion inclined upwardly and outwardly from said root section to a sharp crest, and an engagement face extending from said crest to said channel floor and disposed substantially perpendicularly thereto, a pawl integrally hinged to said head in said head opening for engaging and gripping said strap, said pawl having a plurality of transversely extending pawl teeth each having a shape complementary to the shape of said rack teeth, said integrally merged portions of said rack teeth root sections and said channel floor defining a plurality of stress lines extending transversely across said channel between said side rails, said strap having its minimum material thickness substantially coincident with said transverse stress lines, and at least one longitudinally extending bead disposed in said channel between and substantially parallel to said side rails, said bead being formed integrally with said channel floor and having a generally rounded outer surface, said bead integrally connecting and longitudinally tying said rack teeth successively together from said engagement face of one rack tooth to said ramp portion of the next adjacent tooth, and said bead forming an elongation of said transverse stress lines and a diversion of said stress lines in a non-linear direction up and over said rounded outer surface thereof to thereby increase the fracture resistance of said strap adjacent said rack teeth root sections where said strap has its minimum material thickness.

2. A cable tie as defined in claim 1 wherein said bead increases the material thickness of said strap in said channel floor along said transverse stress lines.

3. A cable tie as defined in claim 1, wherein said bead has a height less than the height of said crests of said rack teeth.

4. A cable tie as defined in claim 1, wherein at least one of said beads is substantially centered in said channel.

5. A cable tie as defined in claim 1, including a plurality of said beads disposed in said channel.

6. A cable tie as defined in claim 5 wherein said beads are substantially semi-cylindrical in shape and have a height less than the height of said crests of said rack teeth.

7. A cable tie as defined in claim 5, wherein said beads are disposed in said channel in substantially equally spaced-apart relation to said side rails.

8. A cable tie as defined in claim 1, wherein said beads include at least one bead disposed in said channel in spaced-apart relation to said side rails and a pair of partial beads disposed in said channel and merging integrally into said side rails.

9. A cable tie as defined in claim 1, wherein said bead is substantially semi-cylindrical in shape.

10. A cable tie as defined in claim 1, wherein said channel floor between said rack teeth root sections and engagement faces is formed with generally rounded concave depressions extending laterally from each side of said bead toward said side rails.

11. A cable tie as defined in claim 10, including a plurality of beads disposed in said channel and said concave depressions between said beads extend substantially from the side of one bead to the side of the adjacent bead.

12. A cable tie as defined in claim 11, wherein said transverse stress lines substantially bisect said concave depressions and said stress lines have a substantially sinusoidal shape.

13. A cable tie as defined in claim 10 wherein the height of said bead is substantially less than the height of said rack teeth crests and the depth of said concave depressions is substantially equal to the height of said bead.

14. A cable tie as defined in claim 10 wherein said bead increases the material cross-sectional area of said strap in said channel floor along said transverse stress lines by an amount that is equal to or greater than the decrease in material cross-sectional area of said strap created by said concave depressions along said transverse stress lines.

15. A cable tie comprising a head portion and an elongated flexible strap portion, said head portion having an opening housing an integrally hinged pawl formed with a plurality of transversely extending pawl teeth, said strap portion being formed with a longitudinally extending channel therein, said channel having a floor defining a rack with a plurality of longitudinally spaced, transversely extending rack teeth, said pawl teeth and said rack teeth having complimentary shapes and being adapted to engage and grip one another when said strap is inserted into said head portion opening, said rack teeth having root sections integrally merging into said channel, crest portions projecting upwardly and outwardly therefrom, and generally perpendicular engagement surfaces interconnecting the crest portion of one rack tooth with the channel floor adjacent the root section of the next successive adjacent rack tooth, and at least one elongated bead extending longitudinally in and integrally formed in said channel floor so as to connect said rack teeth together, said bead having a generally rounded outer surface and a height less than the height of said tooth crests so that the transverse edges of said crests are uninterrupted.

16. A cable tie as defined in claim 15 wherein said pawl teeth have root sections integrally merging into said pawl, sharp crest portions projecting outwardly therefrom, and generally perpendicular engagement surfaces interconnecting the crest portion of one pawl tooth with the pawl adjacent the root section of the next successive pawl tooth, said sharp crest portions of said pawl teeth defining substantially linear transversely extending edges prior to gripping engagement with said rack teeth, and said transversely extending edges of said pawl teeth being deformable to conform generally to the contour of said rounded outer surface of said bead when said pawl teeth are pulled into firm gripping engagement with said rack teeth.

17. A cable tie as defined in claim 16 including a plurality of said beads disposed in said channel in substantially equally spaced-apart relation to one another.

18. A cable tie as defined in claim 15, wherein said channel floor between said rack teeth root sections and engagement faces is formed with generally rounded concave depressions extending laterally from each side of said bead.

19. A cable tie as defined in claim 18, including a plurality of beads disposed in said channel and said concave depressions between said beads extend substantially from the side of one bead to the side of the adjacent bead.

20. A cable tie as defined in claim 19, wherein the depth of said concave depressions is substantially equal to the height of said bead.

* * * * *